US007536794B2

(12) United States Patent
Hay et al.

(10) Patent No.: US 7,536,794 B2
(45) Date of Patent: May 26, 2009

(54) FOOT MEASUREMENT, ALIGNMENT AND EVALUATION DEVICE

(75) Inventors: Gordon G. Hay, Marblehead, MA (US); Keith M. Orr, Boston, MA (US); Derek Carroll, Marblehead, MA (US)

(73) Assignee: Bivab, LLC, Marblehead, MA (US)

( * ) Notice: Subject to any disclaimer, the term of this patent is extended or adjusted under 35 U.S.C. 154(b) by 0 days.

(21) Appl. No.: 11/914,995

(22) PCT Filed: May 19, 2006

(86) PCT No.: PCT/US2006/019367

§ 371 (c)(1),
(2), (4) Date: Nov. 20, 2007

(87) PCT Pub. No.: WO2006/127428

PCT Pub. Date: Nov. 30, 2006

(65) Prior Publication Data

US 2008/0184572 A1 Aug. 7, 2008

Related U.S. Application Data

(60) Provisional application No. 60/683,224, filed on May 20, 2005.

(51) Int. Cl.
*A43D 1/02* (2006.01)
*A61B 5/107* (2006.01)

(52) U.S. Cl. ..... 33/3 B; 33/515; 33/286

(58) Field of Classification Search ..... 33/3 B, 33/515, 286, 3 R, 6, 3 A, 3 C, DIG. 21
See application file for complete search history.

(56) References Cited

U.S. PATENT DOCUMENTS

| | | | |
|---|---|---|---|
| 234,205 | A | 11/1880 | Schaefer |
| 1,624,171 | A | 4/1927 | Johnson |
| 2,522,899 | A | 9/1950 | Schlaugh et al. |
| 2,782,504 | A | 2/1957 | Pesco |
| 3,579,837 | A | 5/1971 | Soriano |

*Primary Examiner*—Christopher W Fulton
(74) *Attorney, Agent, or Firm*—Davis & Bujold, P.L.L.C.

(57) ABSTRACT

A foot measuring or sizing device comprising a base platform, a heel support (28), an alignment fin (6) and a measurement scale (16). The heel support is pivotally connected to the base platform and the foot fin being slidably along an elongate slot formed in the base platform to facilitate alignment of the foot to be measured with a central axis or plane of the foot measuring or sizing device prior to determining a length, measuring a width and/or determining the amount of lift or adjustment of the foot to be measured is necessary to properly support a foot while using footwear.

27 Claims, 13 Drawing Sheets

FOOT MEASUREMENT, ALIGNMENT AND EVALUATION DEVICE

FIELD OF THE INVENTION

The present invention relates to a foot measuring or sizing device for more accurately determining the characteristics of a foot so that properly sized footwear can be selected and ensure proper support for the person's foot during use of footwear.

BACKGROUND OF THE INVENTION

As is conventionally used in the art, a Brannock foot measuring device is used to measure the overall length and width of the foot to determine the proper size of the footwear to accommodate the foot of a person. However, one of the drawbacks associated with this prior art device is that it does not provide a precise shoe size for a foot, e.g., while it may indicate a fairly accurate overall length of a foot, the device tends to be somewhat deficient in it width measurement and is incapable of determining the proper lift or support for the foot, so that the person may be fitted, in quite a few instances, with an improper size and/or width footwear which is either too large or too small for the person's foot.

SUMMARY OF THE INVENTION

Wherefore, it is an object of the present invention to overcome the above mentioned shortcomings and drawbacks associated with the prior art.

Another object of the present invention is to provide a measuring or sizing device which provides a true and accurate measurement of the overall width of the foot and/or proper lift or support for various portions of the foot so that the person can be always fitted with properly sized footwear, i.e., fitted with footwear having the properly length, width, lift and/or support for properly aligning the person's foot when wearing footwear.

A further object of the present invention is to provide a measuring or sizing device which ensures that the foot, ankle and/or knee are aligned in a truly vertical orientation, prior to taking any measurement(s) relating to the length, width, lift and/or support so that a more accurate, precise and reliable measurement concerning the overall length, width, lift and/or support of the foot is obtained.

Yet another object of the present invention is to provide a measuring or sizing device having a heel support which is pivotable or adjustable to alter the orientation of the foot, when taking a measurement, to facilitate lifting or altering the orientation or position of the foot and determine any necessary lift and/or support required by to be provided by the footwear in order to properly support the foot during use of such footwear.

A still further object of the present invention is to a foot measuring or sizing device comprising: a base platform; a heel support for support a heel portion of a foot to be measured, and the heel support being pivotally connected to the base platform; and the foot measuring or sizing device having a measurement scale for indicating at least a length dimension of the foot to be measured The present invention also relates to a foot measuring or sizing device comprising: a base platform; a heel support for support a heel portion of a foot to be measured, and the heel support being pivotally connected to the base platform; the foot measuring or sizing device having a measurement scale for indicating at least a length dimension of the foot to be measured; and a foot fin supported by the base platform and the foot fin being slidably along an elongate slot formed in the base platform to facilitate alignment of the foot to be measured with a central plane of the foot measuring or sizing device prior to reading a length of the foot to be measured from a length scale.

The present invention also relates to a foot measuring or sizing device comprising: a base platform; a heel support for support a heel portion of a foot to be measured, and the heel support being pivotally connected to the base platform; the foot measuring or sizing device having a measurement scale for indicating at least a length dimension of the foot to be measured; a foot fin supported by the base platform and the foot fin being slidably along an elongate slot formed in the base platform to facilitate alignment of the foot to be measured with a central plane of the foot measuring or sizing device prior to reading a length of the foot to be measured from a length scale; at least one slidable foot width measurement device for engaging with the first metatarsal head of the foot of the person during use; and a pair of alignment uprights being located on opposite sides of the heel support to provide a visual indication to an operator of the measuring or sizing device that an ankle/shin of the foot to be measured is aligned substantially parallel to the alignment uprights.

BRIEF DESCRIPTION OF THE DRAWINGS

The invention will now be described, by way of example, with reference to the accompanying drawings in which.

DETAILED DESCRIPTION OF THE INVENTION

Figure 1A:
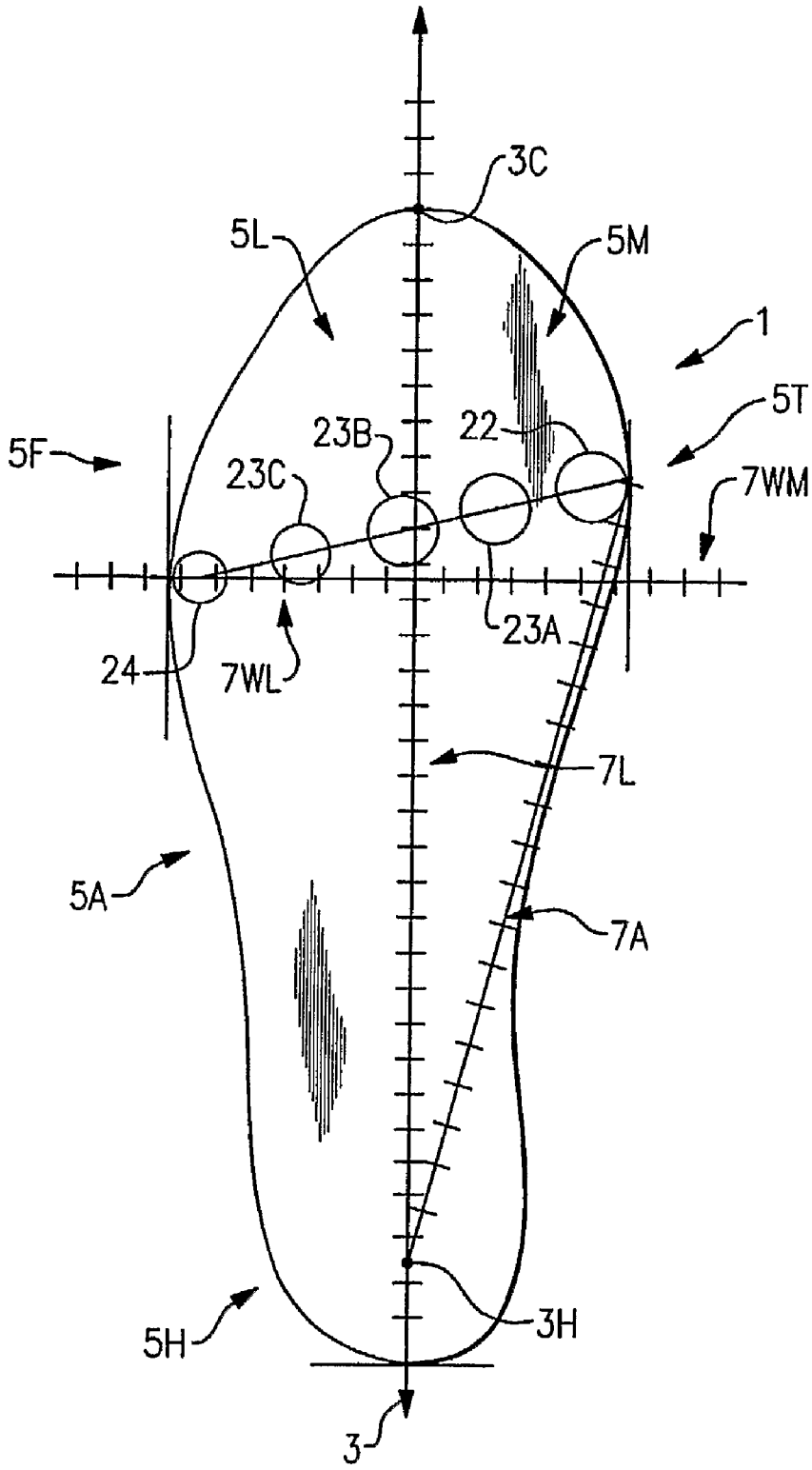
FIG. 1A is a diagrammatic top view of foot measurements taken by the present measuring device.
Figure 1B:
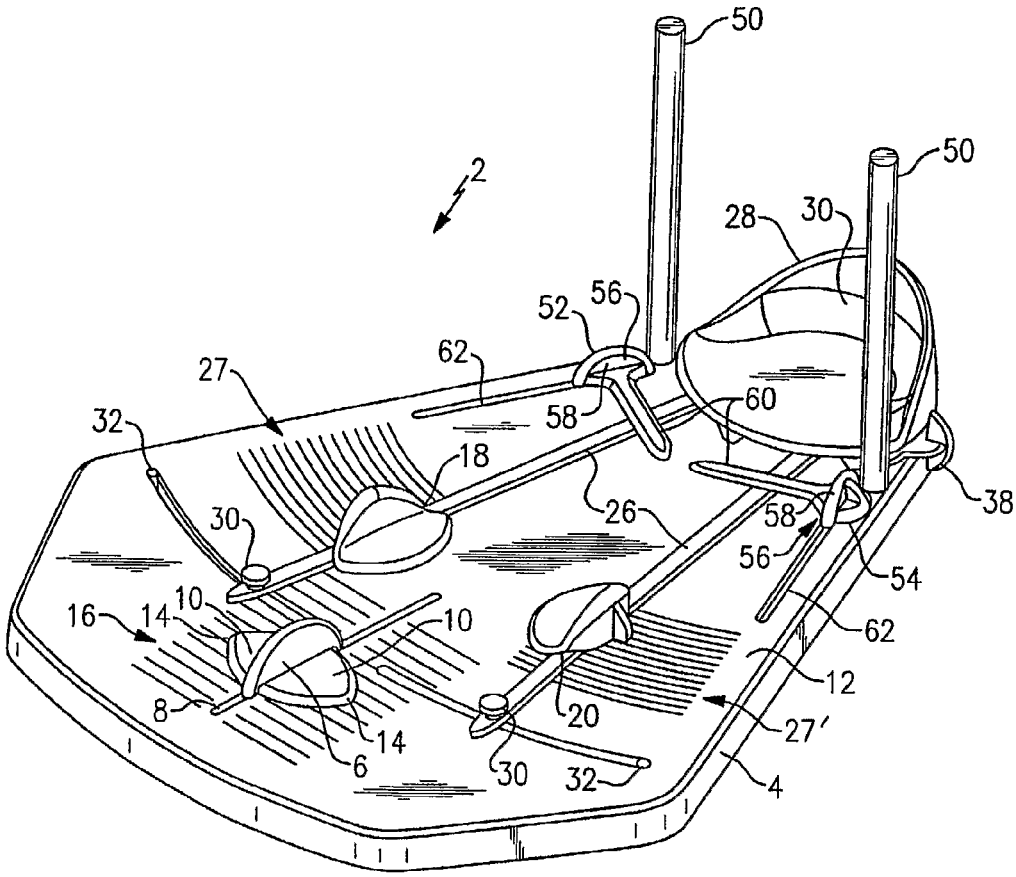
FIG. 1B is a front, top perspective view showing the improved the measuring or sizing device.

Referring first to FIG. 1A, therein is illustrated the measurement principles and mechanisms of the improved measuring device of the present invention using, as an illustrative example, a top view of a foot 1, herein shown as a left foot. As shown therein, and according to the present invention, a centerline 3 extending from a center point 3H of the heel and through a designated center reference 3C located at the front of the foot 1 point axially divides foot 1 into a lateral or outer "half" 5I and a medial or inner "half" 5M. The foot is further longitudinally divided into a fore section 5F, a metatarsal section 5T, an anterior section 5A and a heel section 5H wherein the fore section 5F and anterior section 5A are generally delineated from one another by a line defined by the first and fifth metatarsal heads 22 and 24 and the three intermediate metatarsal heads 23A, 23B and 23C. The sizing device 2 of the present invention thereby recognizes that not all feet conform to the same contours and that, as a result, measurement of the medial side of a foot, as is customary, may not reveal accurate information regarding the dimensions of the lateral side of the foot, and the reverse. A sizing device 2 of the present invention accordingly addresses this problem by dividing the foot into two halves and providing measures particular to each side, thereby providing a more accurate representation of the foot.

As will be described in further detail in the following, a sizing device 2 of the present invention determines, among other measurements and alignments, a foot length measured by a length measurement mechanism 7L that extends from the aftermost part of the heel and along centerline 3 to the most forward point of the foot 1 at center reference 3C. A sizing device 2 further determines an arch length measured by an arch length measurement mechanism 7A that extends from the region of center point 3H of the heel, and a foot width measured by a foot width measurement mechanism 7W that, as described in the following, may be comprised of a lateral width mechanism 7WL or a lateral width mechanism 7WI together with a median width mechanism 7WM. As will also be described in the following, a sizing device 2 of the present invention measures or determines yet other measurements and alignments associated with measurements of the foot, such as the vertical alignment of the ankle or angle and knee joint with respect to centerline 3, an appropriate height and side to side tilt of the heel section 5H with respect to fore and anterior sections 5A and 5F, and so on.

Therefore next considering FIGS. 1B, 2A-2D, 3 and 4, a detailed description of an embodiment of a measuring or sizing device 2 will now be considered in detail. As shown in therein, the measuring or sizing device 2 generally comprises a base platform 4 which is sized to be much larger in both length and width than a typical foot of a person to be measured. Typically, the base platform 4 has a length of between 12 and 24 inches or so and a width of 5 and 14 inches or so.

A foot fin 6 is centrally located on the base platform 4 and the foot fin 6 is slidably along an elongate slot 8 formed in the base platform 4. The foot fin 6 has a pair of opposed lateral guides 10 which slide along the top surface 12 of the base platform 4. The base platform 4 has a foot length measurement scale 16 provided on a top surface 12 thereof which cooperates or interacts with the foot length indicators 14 of the lateral guides 10 to indicate the actual length of the foot to be measured. When a measurement of a foot is being taken, the foot fin 6 is designed to be located between the big toe and the adjacent toe of the person's left or right foot. The foot fin 6 will help align the foot of the person with a central plane C of the measuring or sizing device 2 prior to taking any measurement of the foot. The foot length is read by taking a visual inspection of the longest toe, i.e., typically the big or the toe adjacent the big toe, with respect to the foot length measurement scale 16. A further detailed discussion concerning measurement of the length of the foot will follow below with references to FIGS. 5-8.

The measuring or sizing device 2 further includes a pair of spaced apart and cooperating foot width measuring devices 18, 20. One of the pair of foot width measuring devices 18 or 20 is designed to be located under and support a first metatarsal head 22 of a foot of a person while the other spaced apart foot width measuring device 20 or 18 is designed to be located under and support the fifth metatarsal head, or possibly the fifth tuberosity, 24 of the foot to be measured. Each one of the foot width measurement devices 18, 20 is slidable along a support shaft 26. A first end of each of the support shafts 26 is pivotally attached adjacent a heel support 28 of the base platform 4 to permit arcuate pivoting motion of the foot width measurement devices 18, 20 while the opposite end of the support shaft 26 is connected to a slide member 30 which slides along an accurate slot 32 provided in the top surface 12 of the base platform 4 and is the pivoting motion is confined by a pair of opposed ends of the accurate slot 32.

Due to this arrangement, each one of the support shafts 26 of the cooperating foot width measuring devices 18, 20 is able to pivot both toward and away from one another, due to their pivotal attachment adjacent the heel support 28, while the foot width measuring devices 18, 20 are both slideable toward and away from the heel support 28 to facilitate location of a first one of the foot width measuring devices 18 or 20 under the first metatarsal head 22 of a person's foot for support thereof when a measurement is being taken while the other one of the foot width measuring devices 20 or 18 can be located under the fifth metatarsal head 24 of the person's foot for support thereof when a measurement is being taken. It is to be appreciated that if the person's left foot is being measured (see FIG. 5), one of the foot width measuring devices 20 will support the fifth metatarsal head 24 of the person's foot while the other one of the foot width measuring devices 18 will support the first metatarsal head 22 while if the person's right foot is being measured, the opposite foot width measuring device 18 will support the fifth metatarsal head 24 of the person's foot while the other foot width measuring device 20 will support the first metatarsal head 22. The width measuring devices 18, 20 are each provided with an arch length measuring scale 27, 27' for indicating the overall length of the arch of a person's foot. In addition, the distance between the pair of foot width measuring devices 20 and 18 also indicates the overall width of the person's foot, e.g., A, B, C, D, E, EEE, etc.

As illustrated in FIGS. 1B and 2A-2D, the trailing portion of the base platform 4 is provided with the heel support 28 which is generally cup-shaped and designed to support the heel of a person when sizing a foot of a person. The heel support 28 also has a contoured, vertical rear wall 30 which provides a reference surface, i.e., a zero measurement position for the length of the foot, against which the rear portion of the heel section 5H of the foot abuts to facilitate determining an accurate measurement of the total length of the person's foot to be measured.

The heel support 28 is pivotally attached to the base platform 4 by a substantially centrally pivot 34, such as a screw interconnecting these two components with one another so as permit the desired tilting, lifting, and/or other adjusting movement of the heel support 28 relative to the base platform 4, as will be discussed below in further detail, without significantly altering the zero measurement length position of the measuring or sizing device 2 for determining the overall length of the foot of the person.

As illustrated in FIGS. 1A and 2A-2D, heel support 28 is provided with a pair of opposed tilting or lifting elements 36, 38 which facilitate tilting or lifting of the heel support 28 over a limited pivot angle, e.g., a pivot angle of between 0 and 15 degrees or so, for example. Each one of the pair of the opposed tilting or lifting elements 36, 38 generally comprises a slidable lifting lever 40 connected to a lifting head 42. Each one of the pair of opposed tilting or lifting elements 36, 38 is captively retained by one of the heel support 28 and the base platform 4 and is slidable to and fro along a slot 44 formed in either heel support 28 or the base platform 4. In the embodiment shown, the tilting or lifting elements 36, 38 and the slots 44 are generally supported by the base platform 4 but an opposite arrange is also possible.

Figure 2A:
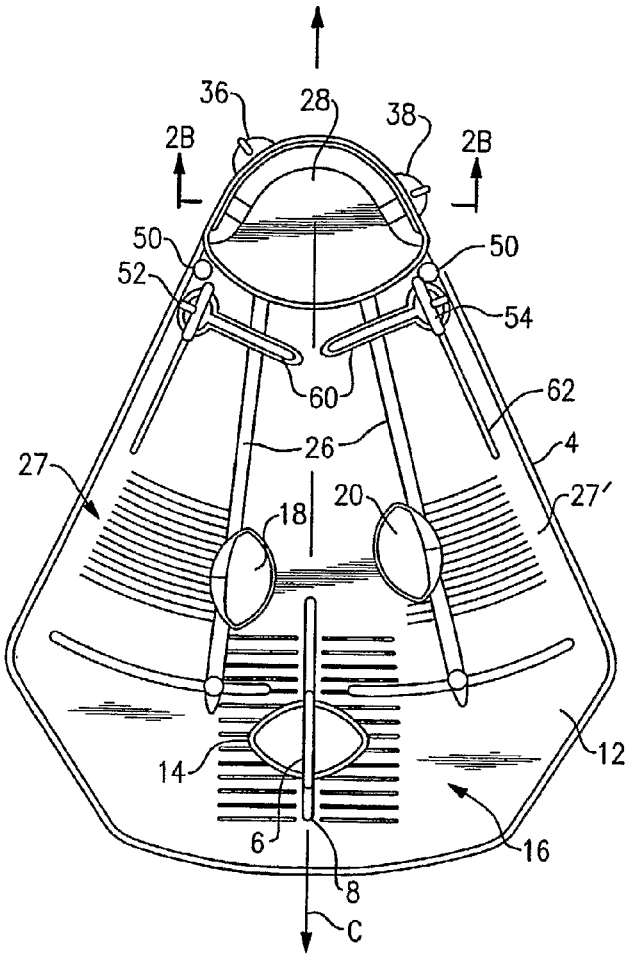
FIG. 2A is a top plan view of FIG. 1.
Figure 2B:
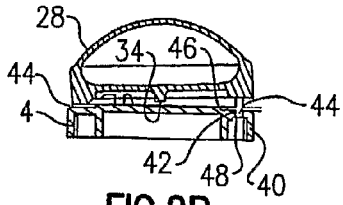
FIG. 2B is a cross-sectional view along section line 2B-2B of FIG. 2.
Figure 2D:
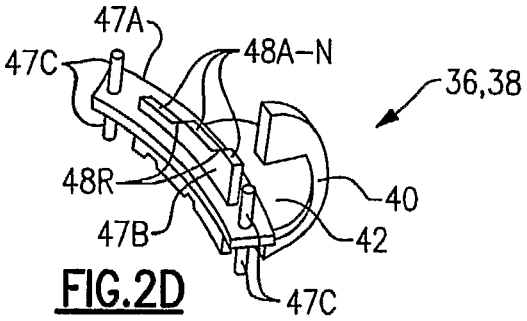
FIG. 2D is a diagrammatic the heel cup lifting elements.
Figure 2C:
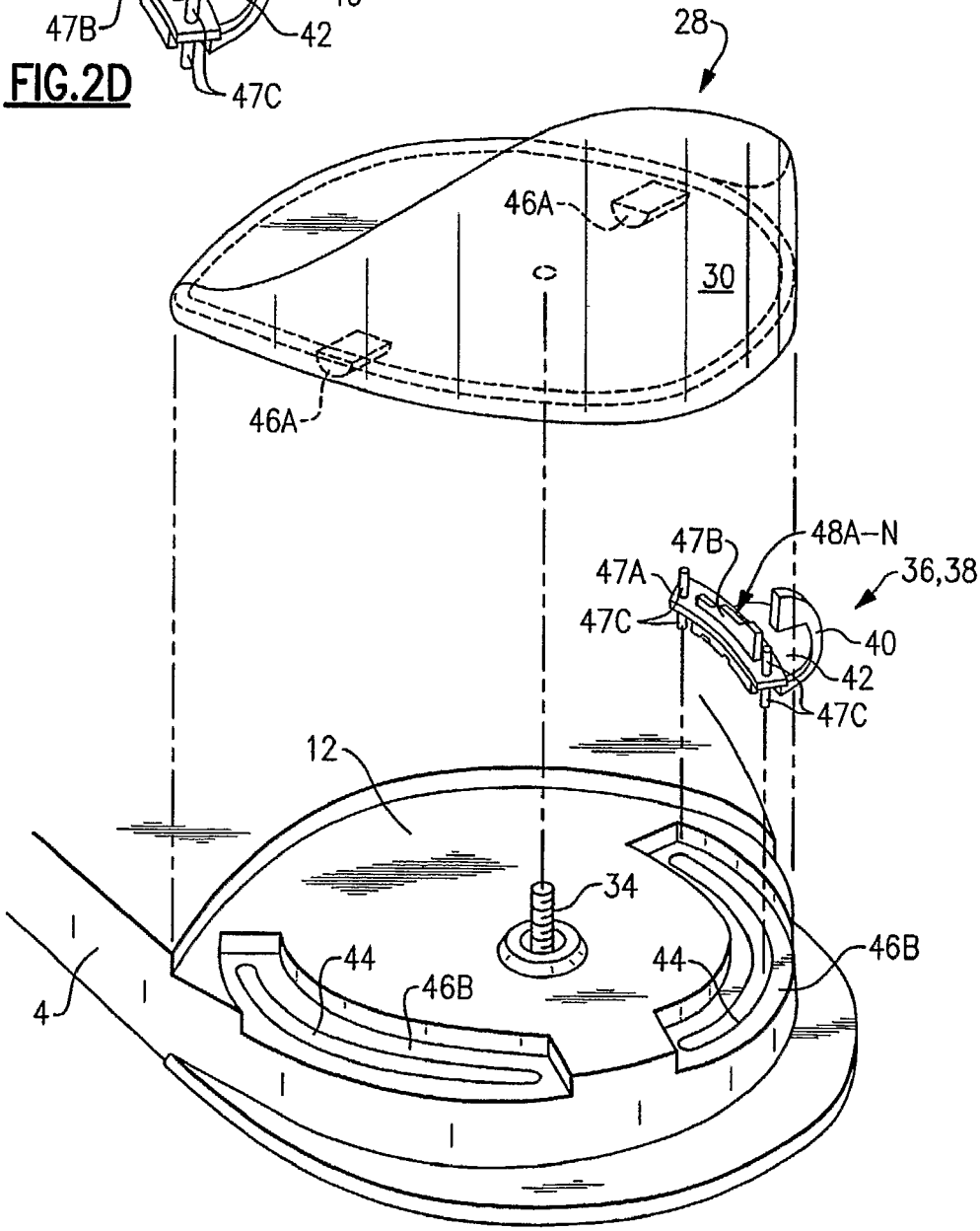
FIG. 2C is an exploded diagrammatic view of the heel cup assembly.
Figure 3:
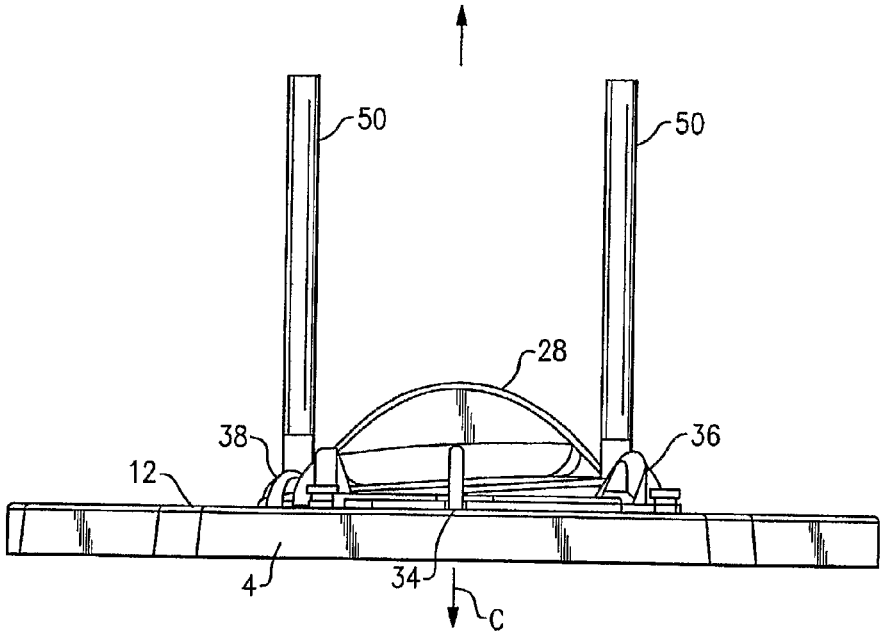
FIG. 3 is a rear elevational view of FIG. 1.
Figure 4:
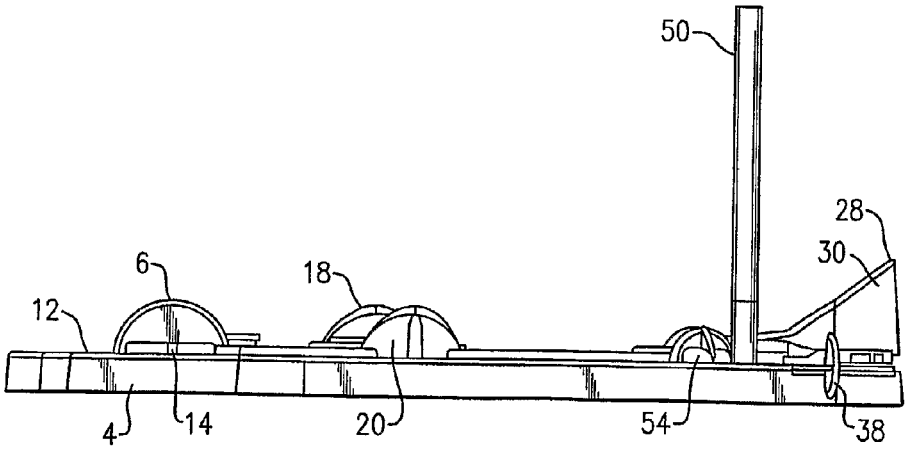
FIG. 4 is a right side elevational view of FIG. 1.
Figure 5A:
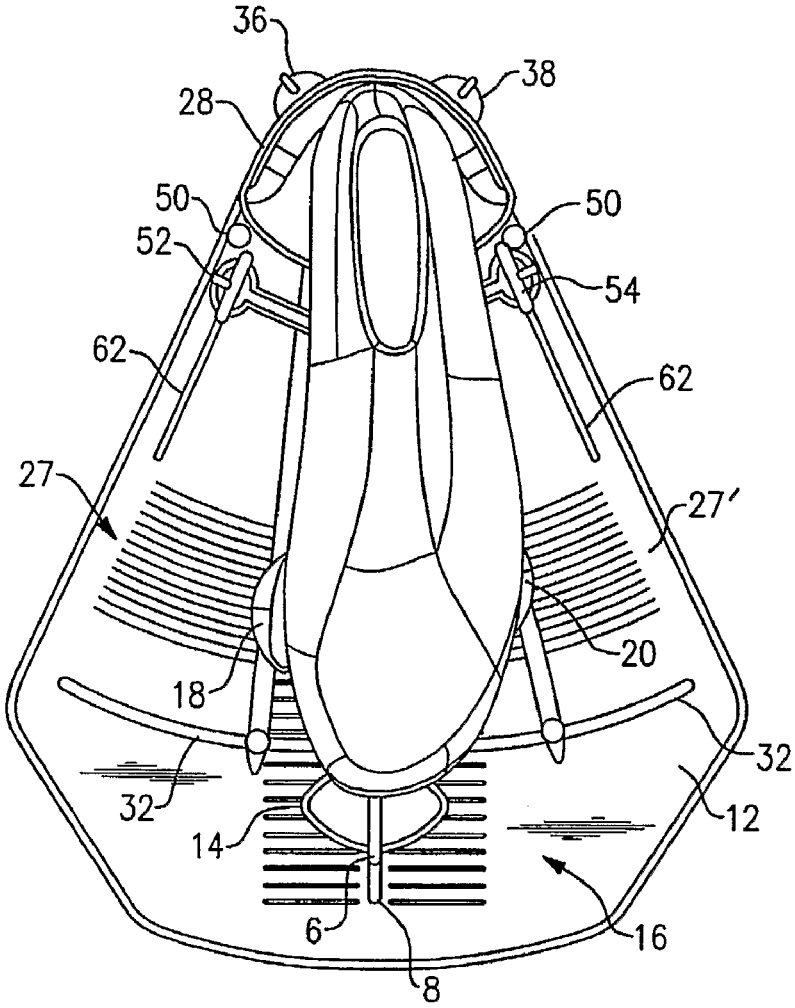
FIG. 5A is a top plan view of the measuring or sizing device with a foot supported thereby for determining the size and width of the foot.
Figure 5B:
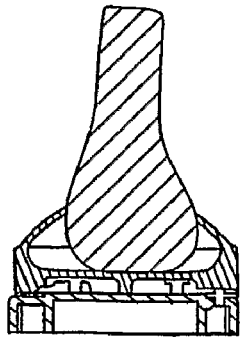
FIG. 5B is a cross-sectional view along section line 5B-5B of FIG. 5.
Figure 6:
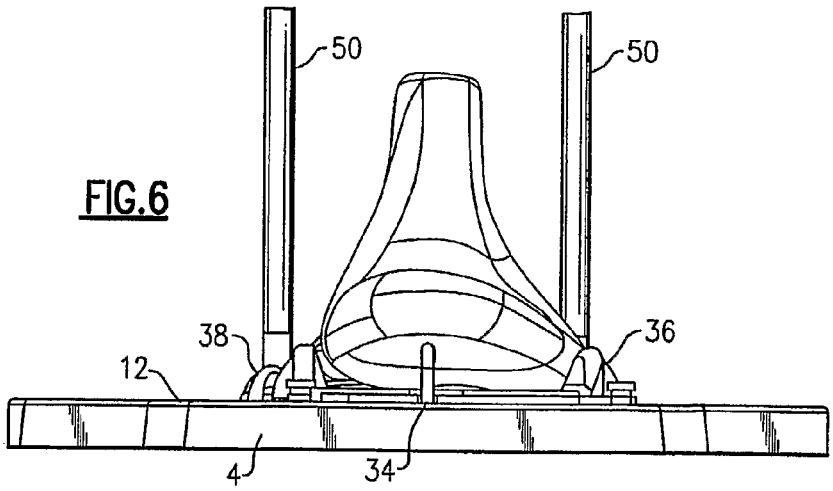
FIG. 6 is a rear elevational view of FIG. 5.
Figure 7:
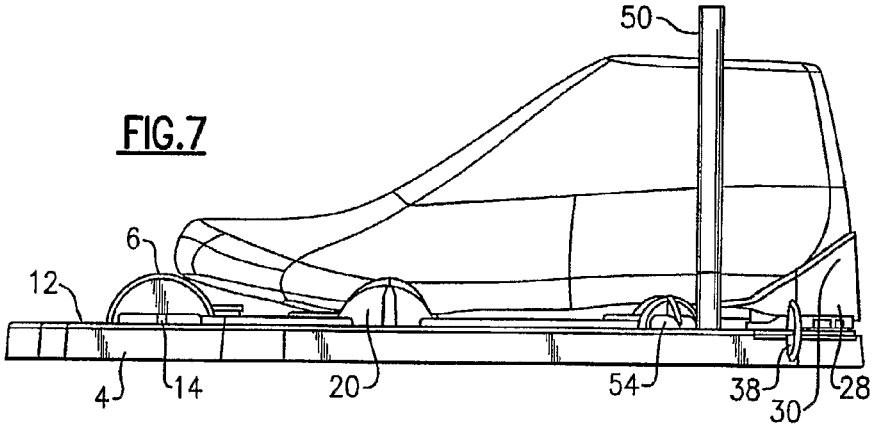
FIG. 7 is a right side elevational view of FIG. 5.
Figure 8:
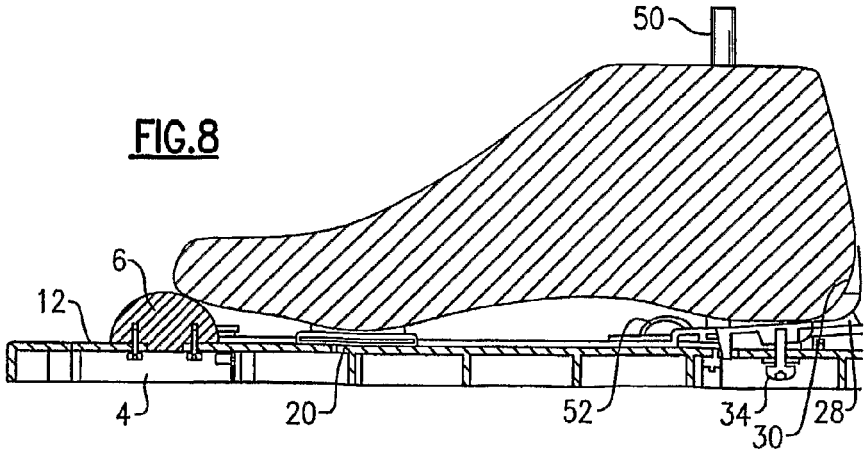
FIG. 8 is a cross-sectional view along section line 8B-8B of FIG. 5.

FIG. 2C is an exploded diagrammatic isometric view of a heel support 28 assembly showing a single one of the pair of lifting elements and FIG. 2D is an enlarged diagrammatic isometric view of one of the lifting elements 36, 38. As shown therein, the recessed undersurface of heel support 28 carries a pair of spaced apart cam support elements 46A, which have a generally domed or semi-cylindrical shape in the presently illustrated embodiment, and base platform 4 carries a pair of cam support surfaces 46B extending on along either side of slots 44. Tilting elements 36, 38, in turn, each of which generally includes a slidable lifting lever 40 connected to a lifting head 42, further includes a cam body 47A that is arcuate shaped to correspond to the general shape and curvature of slots 44 and that is of a width to slidably bear upon and slide along the cam support surfaces 46B extending along each slot 44. Each cam body 47A includes a cam structure 47B that extends longitudinally along cam body 47A and is curved to match the curve of cam body 47A. As shown, the upper surface of each cam structure 47B is shaped into a plurality of cam surfaces 48A-48n of progressively graduated elevations joined by sloping ramp surfaces 48R. Each cam body 47A further includes a pair of perpendicular retaining pins 47C located nears the corresponding ends of cam body 47A and that engage into the corresponding slot 44 to retain the corresponding tilting elements 36,38 in engagement with the corresponding slots 44, cam support surfaces 46B and cam support elements 46A. In this regard, it will be noted that in the embodiment illustrated in FIGS. 2C and 2D tilting elements 36,38 are each constructed as mirror symmetric elements having, for example, upper and lower mirror pairs of retaining pins 47C and corresponding upper and lower mirror pairs of cam structures 47B with cam surfaces 48A-48n and ramp surfaces 48R, so that a single design of tilting elements 36,38 can serve as both tilting elements 36 and as tilting elements 38.

Tilting elements 36,38 each slide along their corresponding slots 44 with their respective retaining pins 47C engaged in the slots 44 and the cam bodies 47A sliding along and supported by the respective cam support surfaces 46B while cam surfaces 48A-48n and ramp surfaces 48R engaging with and supporting the corresponding cam support elements 46A on the underside of heel support 28. As such, it will be apparent that the distance between a given cam support element 46A and base platform 4, and thus the height of heel support 28 relative to base platform in the region of that cam support element 46A, will be determined by the position of the tilting element 36,38 along the corresponding slot 44, and the relative location of pivot 34.

As a consequence, positioning a tilting element 36,38 toward the forward portion of the corresponding slot 44 arc will result in that side of heel support 28 being raised with respect to base plate 4 while positioning the tilting element 36,38 toward the rearward portion of slot 44 arc will result in that side of heel support 28 being lowered with respect to base plate 4. The combination of tilting elements 36,38 and pivot 34 will thereby allow heel support 28 to be tilted from side to side by approximately 15°, in a present embodiment, and will allow the rearward portion of heel support 28 to be raised or lowered with respect to base plate 4 by a similar amount.

As will also be noted, in a present embodiment the arc segments defined by slots 44 and cam surfaces 46B are generally located toward the side and rear quadrants of heel support 28 with respect to pivot 34, rather than toward the forward quadrant of heel support 28, but the forward portions of the arcs extend forward of pivot 34. One result of this arrangement is that heel support 28 effectively pivots or rotates about a horizontal and laterally extending "virtual" axis located some distance forward of the forward edge of heel support 28, thereby allowing heel support 28 to be raised and lowered with respect to anterior section 5A as well as tilted forward and aft and side to side with respect to the base plate 4. In addition, it will also be noted that in the presently illustrated embodiment the arcs defined by slots 44 are not circumferential with respect to pivot 34 and that the forward portions of the arcs defined by slots 44 instead diverge radially outward with respect to pivot 34. This arrangement also provides a more stable platform by allowing the maximum side to side width between the forward ends of slots 44 and allows slots 44 to be longer than would be possible if slots 44 were circumferential with respect to pivot 34, thereby allowing finer adjustment and a greater range of adjustment for tilting elements 36,38.

Next, a present embodiment of a sizing device 2 as illustrated in FIGS. 1A-11 may include a pair of alignment posts or vertical uprights 50 are located on opposite sides of the heel support 28 and the two alignment uprights 50 provide a visual indication to an operator of the measuring or sizing device 2 as to whether or not the ankle/shin section of the foot to be measured are aligned substantially parallel to the vertical uprights 50. In the event that the ankle/shin of the foot to be measured is, in fact, aligned substantially parallel to the vertical uprights 50, not adjustment of the tilting or lifting elements 36 or 38 is required and the operator can then proceed with properly measuring or sizing the foot. In the event that this is not the case, the operator will slide or adjust one or both of the tilting or lifting elements 36, 38, as necessary, until ankle/shin of the foot to be measured is visually aligned substantially parallel to the vertical uprights. Once this is achieved, the operator can then proceed with properly measuring or sizing the foot of the person.

A pair of clearance elements 52, 54 are supported by the top surface 12 of the base platform 4 and each one of the clearance elements 52, 54 is located between the heel support 28 and the foot width measuring devices. Each one of the clearance elements 52, 54 comprises a slide member 56 which has a vertically extending side wall 58 which is located to abut against a lateral or medial side of the foot to be measured. In addition, a clearance arm 60 extends substantially perpendicular to the vertically extending side wall 58 and the clearance arm 60 is located to slide underneath the foot to be measured to check and confirm that there is sufficient clearance between the bottom of the foot to be measured and the top surface 12 of the base platform 4. Each one of the clearance elements 52, 54 is slidably retained within an elongate clearance slot 62 and is slidable axially therealong to measure clearance between the bottom surface of the person's foot and the base platform 4. The foot clearance elements 52, 54 indicate whether a sufficient amount of tilting or lifting by the heel support 28, via the tilting or lifting elements, has been achieved for the foot to be measured. The foot clearance elements 52, 54 are typically used in combination with the tilting or lifting elements 36, 38 to determine when a sufficient amount, if any, of lifting of the foot to be measured has been achieved by the heel support 28.

In the event that either one of the foot clearance elements 52, 54 can not slide freely along its associated slot between the bottom of the foot and the top surface 12 of the base platform 4, then the associated tilting or lifting elements 36, 38 is moved a small distance toward the leading front portion of the base platform 4 and the operator will then again check to see if there is a sufficient amount of clearance between the bottom surface of the foot and the top surface 12 of the base platform 4. If not, the associated left or right tilting or lifting head 42 is again moved a small distance toward the front portion of the base platform 4 and the operator again checks to see if there is a sufficient amount of clearance between the bottom of the foot and the top surface 12 of the base platform 4. This procedure is repeated until the operator determines that there is a sufficient amount of clearance is provided between the bottom surface of the foot and the top surface 12 of the base platform 4. Once this has been achieved and the ankle/shin section of the foot to be measured are still aligned substantially parallel to the vertical uprights 50, the operator is now ready to measure or size the foot, i.e., determine both the length and width of the foot to be measured.

With reference now to FIGS. 5-8 of the drawings, a detailed description concerning use of the measuring or sizing device 2 for properly size the foot of a person will now be provided. The person will first place his or her foot on the top surface 12 of the base platform 4 such that the heel of the person is captively supported by the cup-shaped heel support 28 with the rear portion of the foot to be measured abutting against the contoured, vertical rear wall 30 of the heel support 28 and the toes of the person extending toward the leading front end of the base platform 4.

The operator of the measuring or sizing device 2 will first operate the foot fin 6, centrally located on the base platform 4, and slidably move the foot fin 6 along the elongate slot 8 formed in the base platform 4 until the foot fin 6 is located between the big toe and the adjacent toe of the person's left or right foot and abuts against the person's foot and can not be moved further toward the heel support 28. Once this occurs, the operator of the measuring or sizing device 2 can be assured that the foot is center along the central plane C of the measuring or sizing device 2 and thereafter, once other adjustments are completed, visually determine the actual length of the foot as indicated by the measurement scale 16 provided on the top surface 12 of the measuring or sizing device 2, i.e., read the scale which indicates the actual length of the foot being measured.

Once this is achieved, the operator of the measuring or sizing device 2 will then ensure that one of the foot width measuring devices 18 or 20, depending upon which foot is being measured, supports the fifth metatarsal head 24 of the person's foot while the other foot width measuring device 20 or 18 supports the first metatarsal head 22.

Next, the operator of the measuring or sizing device 2 adjusts one or both of the pair of opposed tilting or lifting elements 36, 38, as necessary, to facilitate tilting or lifting of the heel support 28 such that the ankle and shin of the person is aligned so as to extend substantially parallel to the pair of vertical uprights 50 located on opposite sides of the heel support 28. In conjunction with such adjustment, the operator of the measuring or sizing device 2 will also utilize the foot clearance elements 52, 54 to confirm whether or not a sufficient amount of lifting of the heel support 28, via the tilting or lifting elements 36, 38, is achieved for the foot to be measured. In the event that either one or both the foot clearance elements 52 and/or 54 is not freely slidable along its associated slot between the bottom of the foot and the top surface 12 of the base platform 4, the associated tilting or lifting elements 36, 38 is moved a small distance toward or away from the leading front portion of the base platform 4 and then the operator will then again check to see if there is a sufficient amount of clearance between the bottom of the foot and the top surface 12 of the base platform 4. This procedure is repeated until the operator determines that there is a sufficient amount of clearance is provided between the bottom lateral and medial sides of the foot to be measured and the top surface 12 of the base platform 4. Once this has been achieved, the operator is now ready to measure or size the foot, i.e., determine the actual length of the foot, the width of the foot, the arch length of the foot and the amount of left or support which is required in order for the foot to be properly supported by the footwear.

A further embodiment of the measuring or sizing device 2 will now be discussed with reference now to FIGS. 8-11. As this embodiment is very similar to the previous embodiment, only differences between this embodiment and the previous embodiment will be discussed in detail.

According to this embodiment, only a single measurement device 18 is provided for engaging with either the first metatarsal head 22 or the fifth metatarsal head 24 of the person's foot being measured and measuring the foot arch length when positioned against the first metatarsal head 22 and the foot lateral width when positioned against the fifth metatarsal head 24. As shown, the foot arch/width measuring device 18 is not configured to support either the first or the fifth metatarsal head when the measurement is being taken. That is, the first or the fifth metatarsal head is supported directly by the top surface 12 of the measuring or sizing device 2. The foot arch/width measuring device 18 is pivoted on the underside of base plate 4 at a point in the region of pivot 34 of heel support 28 and passes to the top side of base plate 4 through a longer elongate slot 32 and is movable along the longer elongate slot 32 to facilitate measuring either the left or the right foot of a person. As with the previous embodiment, two scales 27, 27' are provided to facilitate measurement of the arch length of either the right foot or the left foot and similar scales may be provided to measure the right and left foot lateral width. To facilitate such measurements, the foot arch/width measuring device 18 has a pair of opposed curved or contoured surfaces 19 which are both shaped to mate with the fifth and/or the first metatarsal head of the foot of the person to be measured.

If desired, the fin 6 could be pivotable about a central pivot to accommodate sizing of either a left foot or a right foot of person.

A laser 66 is included in this embodiment of the invention and the laser 66 is slidably attached to a cross bar 68 preferably positioned to the front portion of the measuring or sizing device 2 such that the cross bar 68 forms a slidable pivot axis 70 relative to the measuring or sizing device 2. The laser 66 is slidable by an operator to and fro along the cross bar 68 to a desired position. In addition to being sildable relative to the cross bar 68, the laser 66 is also vertically pivotable relative to the cross bar 68 about pivot axis 70. Preferably, the laser 66 is located along the center plane C of the measuring or sizing device 2 and can be pivoted vertically within that plane C, by an operator of the measuring or sizing device 2, such that a beam emitted from the laser 66 (not shown) will point at the knee of the person of the foot being measured which is coincident with the central plane C. As the laser 66 is generally positioned along the center plane C line of the measuring or sizing device 2 and is able to pivot about the central plane C bisecting the center of the measuring or sizing device 2, the beam from the laser 66 is able to indicate to the operator of the measuring or sizing device 2 whether or not a center of mass of the knee is precisely positioned within, along and coincident with the central plane C of the foot and the measuring or sizing device 2. In the event that the center of mass of the knee is not so positioned, the beam emitted from the laser 66 will indicate whether the center of mass of the knee is either to the left or the right of the central plane C and this information further assists the operator with properly sizing footwear for the foot of the person being measured.

Alternatively, the laser 66 can be fixedly positioned along the central plane C of the measuring or sizing device 2 and being able to pivot about a first pivot axis 70 extending normal to the central plane C. Preferably, the laser 66 is also provided with a second pivot axis 72, extending normal to the first pivot 70 and parallel to the central plane C. As the laser 66 pivots about the second axis 72, the laser 66 forms an angle with respect to the central plane C and this angle indicates an amount of deviation which the laser 66 pivots, about the second pivot axis 72 and relative the central plane C of the measuring or sizing device 2, and indicate to the operator how far the center of mass or some other desired body part, in angular degrees, is located away from the central plane C defined by the foot and the measuring or sizing device 2. It will be appreciated that this arrangement with pivots 70 and 72 may also be slidably mounted onto a horizontally extending lateral cross bar 68 in the manner described above to allow centerline and center of mass measurements and alignments to be determined, for example, with respect to a centerline of the foot, of the measuring device or, for example, the knee or ankle, or with respect to an offset with respect to the centerline of foot, the measuring device, or, for example, the knee or ankle.

Once the foot is properly measured by the measuring or sizing device 2, the operator is then able to determine the specifics of the shoe required to properly accommodate the foot and provide any desired lift, tilt or other desired adjustment to a footbed or some other foot insert so that the foot will be properly oriented while wearing footwear. In particular, the present invention is useful in determining appropriate design for a transverse arch bridge support (TABS) which can be attached to an undersurface of a footbed or some other foot insert to provide the desired lift, tilt, alteration or other adjustment to the footbed or some other foot insert so that the foot is properly supported while use of the footwear.

One arrangement for the laser 66 is to pivotally mount the laser 66 on a flat surface, similar to a sun dial, and locate this flat surface at the front of the measuring or sizing device 2 and coincident with the central plane C of the measuring or sizing device 2. The flat surface would be pivotal about a first axis 70 extending normal to the central plane C and positioned in front of the foot to be measured. The laser 66 would also be pivotal, relative to the flat surface, about a second pivot axis 72, extending normal to the first pivot axis 70 and parallel to the central plane C. Any deviation of the laser 66, about the second pivot axis 72 and relative the central plane C of the measuring or sizing device 2, will determine a leg curvature angle relative to center knee mass of the person being measured.

It will be appreciated that any of the above laser 66 arrangements may also be mounted to the rear of the heel of the measuring device, instead of to the front of the device and that these arrangements can be mounted on a single, laterally extending horizontal bar or on one or a pair of vertical posts.

It is to be appreciated that two or more lasers may be used together with a measuring or sizing device 2 for determining desired separation points for aligning the entire body including the feet, the hip, the shoulders, etc., of the person being measured or possibly to measure two or more people at the same time.

Laser 66 may also to mounted or utilized from determined measurements which may migrate into footwear to illuminate paths that train and or display gate patterns as a body of the person is in motion; for example, by possibly placing a laser 66 on or in a shoe and letting the person walk. The device could be as simple as suspending the foot for scanning/measuring in the air with one contact load point proximal to the head, rather than the tuberosity, of the fifth metatarsal. Also, the entire device can be shimmed and or angled bi-laterally to determine center knee mass location relative to the toes, and the device may have one cut out suspension zone suspending the tuberosity extending posterior of the fifth metatarsal head, and or the fifth metatarsal head, and or the fifth toe, and the entire second toe and metatarsal.

Figure 9:
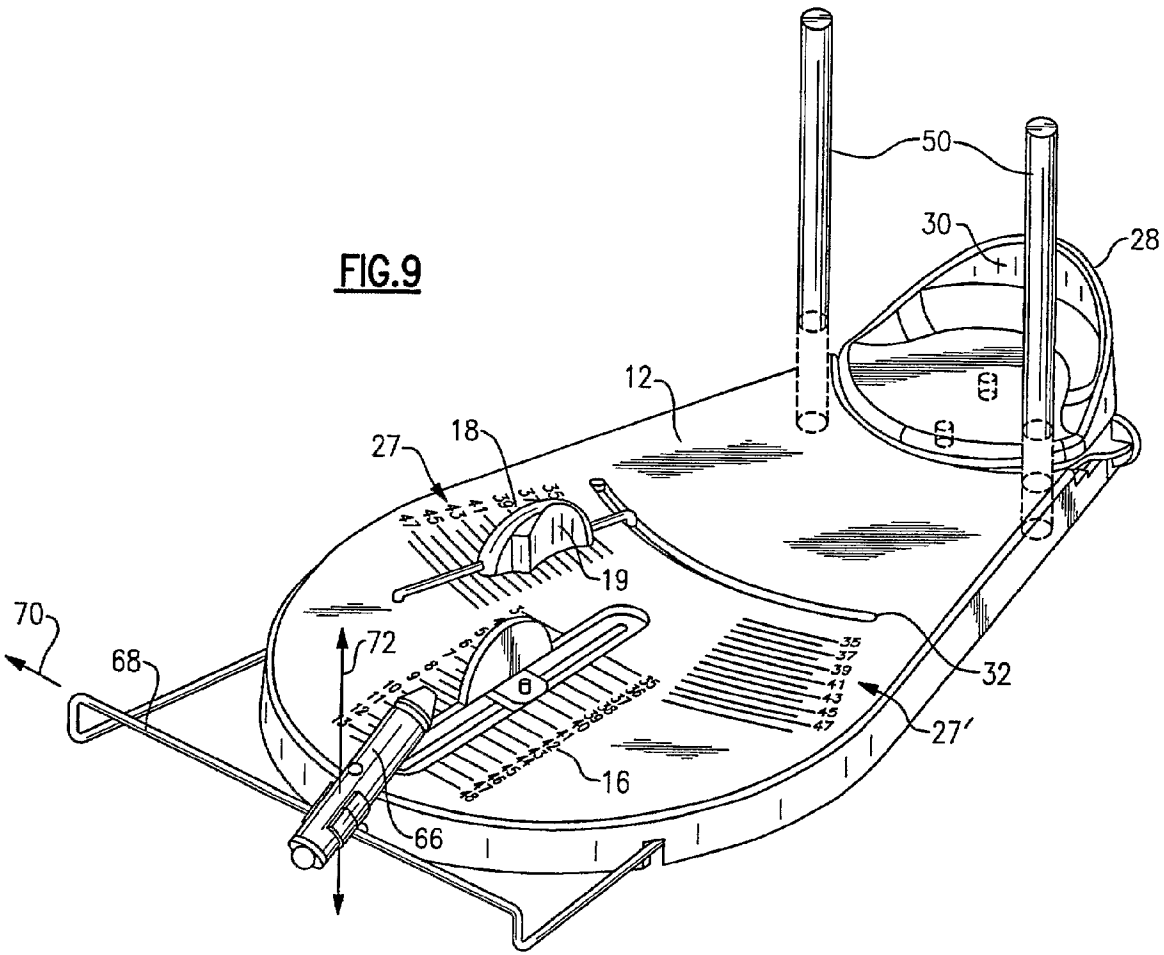
FIG. 9 is a front, top perspective view of another embodiment of the measuring or sizing device.
Figure 10:
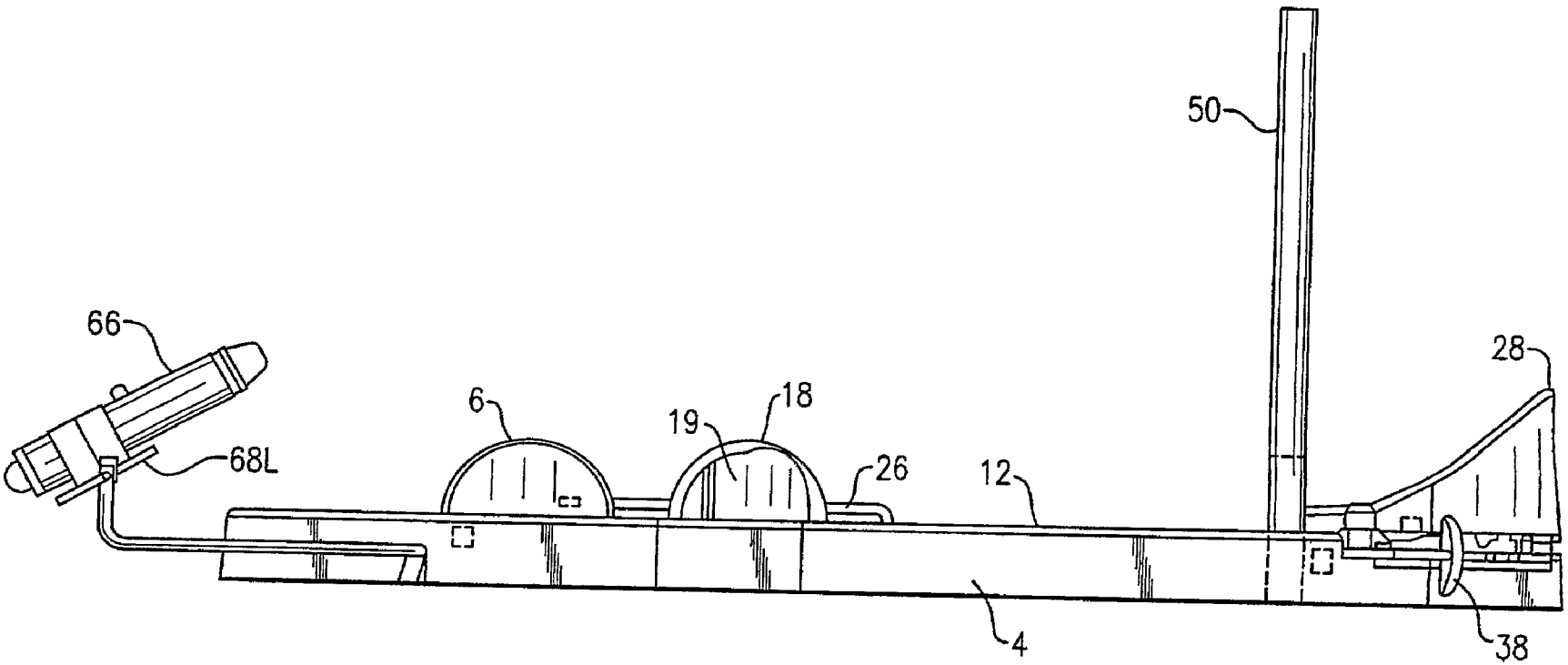
FIG. 10 is a right side elevational view of FIG. 9.
Figure 11:
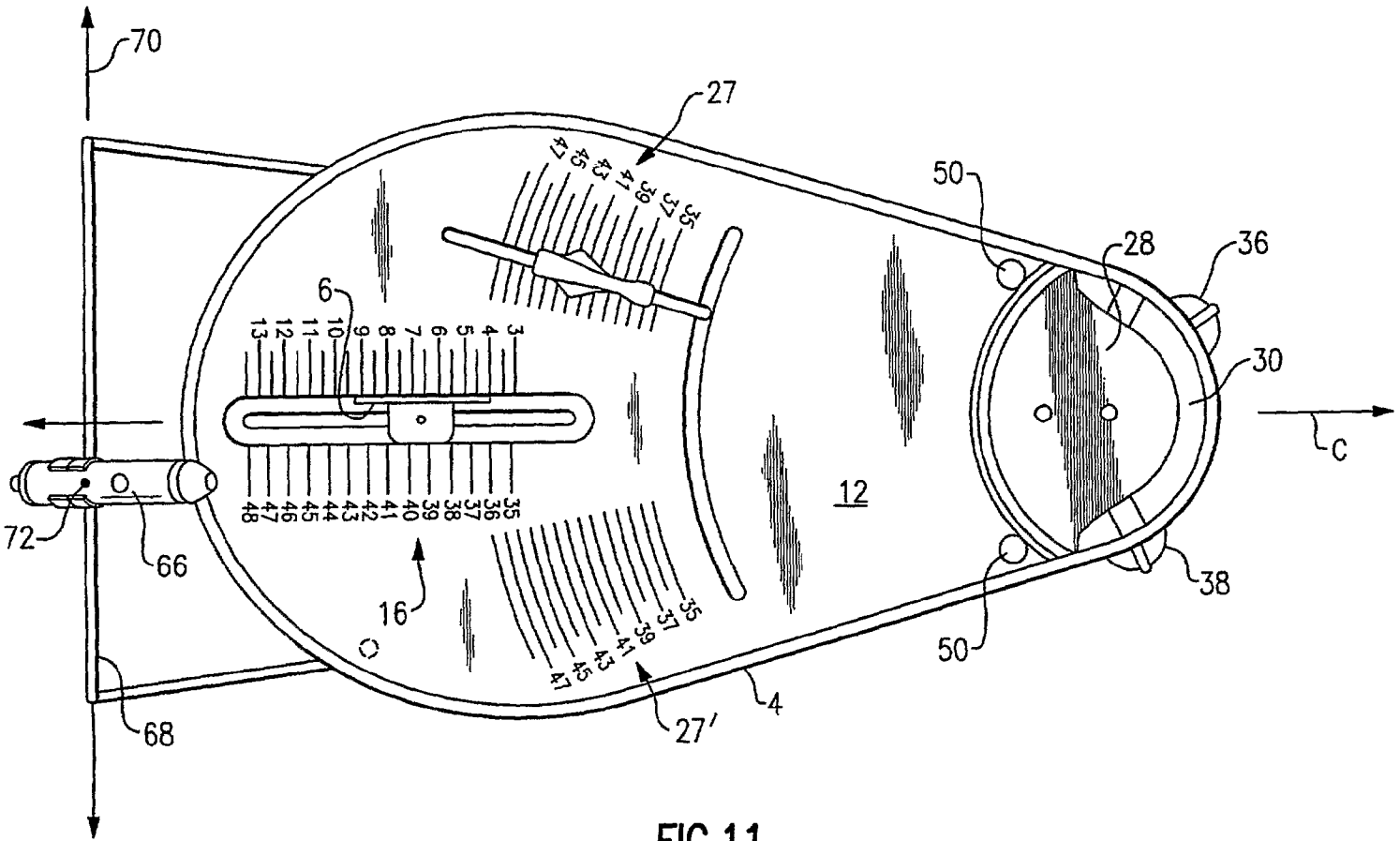
FIG. 11 is a top plan view of FIG. 10.
Figure 12:
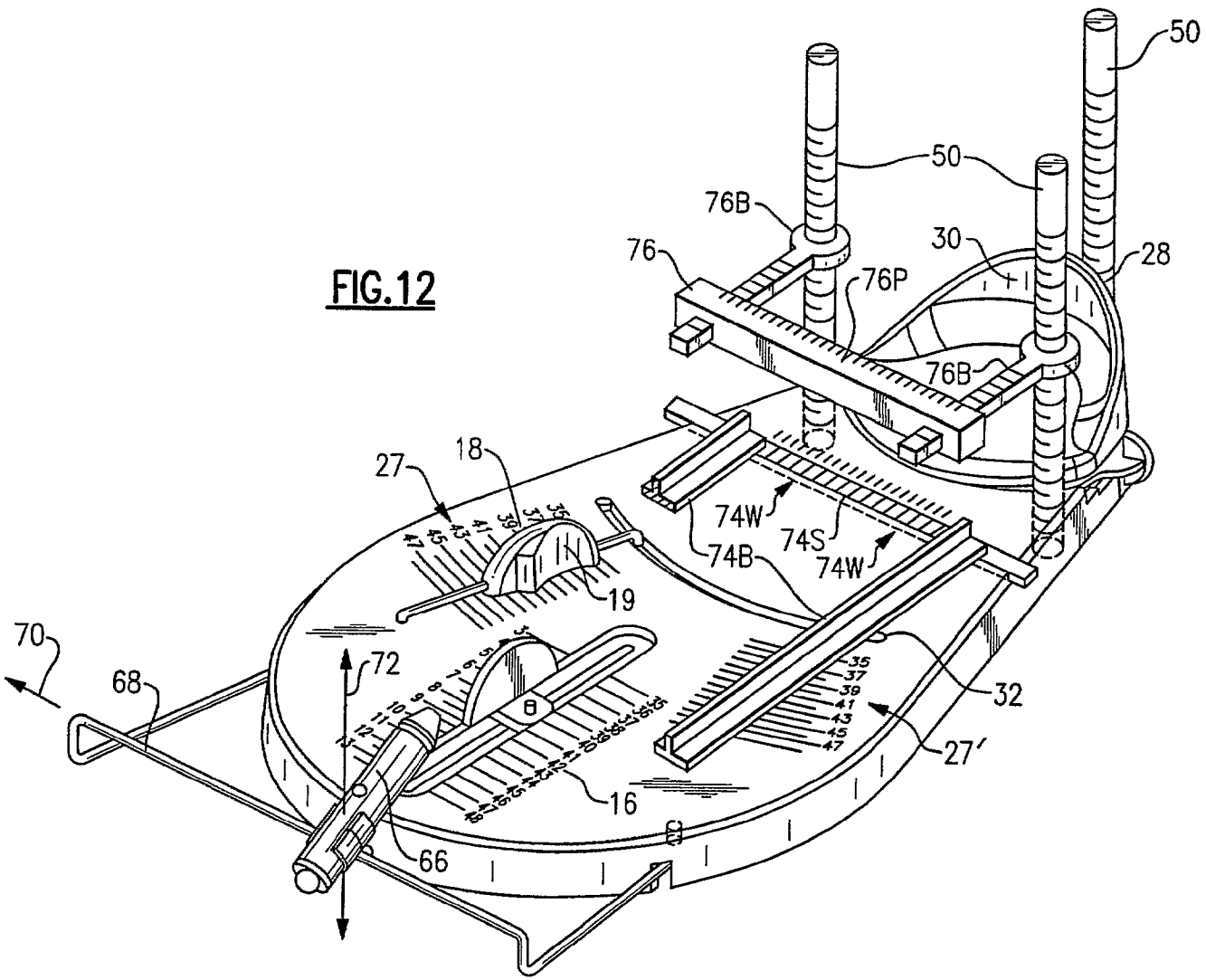
FIG. 12 is an alternate embodiment of certain elements of a foot measuring device; and, FIGS. 13A, 13B and 13C are alternate embodiments of certain elements of a foot measuring device.

Therefore considering further and alternate embodiments of a sizing device 2 of the present invention in greater detail, FIG. 12 illustrates an embodiment similar to that of FIGS. 9 and 11 wherein the foot arch/width measuring device 18 is configured to measure the foot first metatarsal arch length. As described, the foot width measuring device 18 is pivoted on the underside of base plate 4 at a point in the region of pivot 34 of heel support 28 and passes to the top side of base plate 4 through a longer elongate slot 32 and is movable along the longer elongate slot 32 to facilitate measuring the first and fifth metatarsal arch lengths of either the left or the right foot of a person with the aid of scales 27, 27'.

In the implementation illustrated in FIG. 12, however, foot width to the lateral side of the foot, that is, to the fifth metatarsal side of the foot, is measured by means of a generally U-shaped width caliper 74. In the exemplary implementation shown in FIG. 12 includes a slide bar 74S mounted in and sliding laterally in a corresponding groove in base plate 4 or an equivalent structural element and parallel width bars 74B, one of which is shown in cut-away form to reduce clutter in the drawing, extending forward from slide bar 74S to contact the medial or lateral side of the foot. Sliding bar 74*s* is moved to the left or right, depending upon whether the right or left foot is to be measured and upon which the width measurement is to be made to the medial or lateral side of the foot and the width is accordingly read from a width scale 74M and is read from a width scale 74W on either slide bar 74S or the plate supporting slide bar 74S. It will be appreciated that this foot width measuring mechanism may also be implemented with a single bar 74B.

Considering still further and alternate embodiments of a sizing device 2 of the present invention as illustrated in FIG. 12, alignment posts 50 may include a horizontal scale 76 extending between alignment posts 50 to allow actual measurement of the distance or angle of alignment or misalignment between the ankle or leg bone and the foot. FIG. 12 illustrates an exemplary embodiment of an ankle/leg position scale 76 wherein the scale 76 is supported on brackets 76B that are mounted onto and slide vertically on alignment posts 50. As shown, brackets 76B include forward extending horizontal supports that support the ankle/leg position scale 76, with ankle/leg position scale 76 sliding forwards and backwards along the horizontal supports. As illustrated, ankle/leg position scale 76 may include a sliding pointer 76P to assist in measuring the horizontal alignment and offset of the ankle or leg with respect to alignment posts 50 and alignment posts 50 may include scales for determining the vertical position at which the alignment measurement is taken with respect to base plate 4 or any other preferred reference level.

It should also be noted that the vertical position scales on alignment posts 50 and the addition of horizontal position scales on the forward extensions of brackets 76B, as indicated in FIG. 12, allow this mechanism to be used to determine the height of the instep at one or more horizontal offsets forward of the ankle or leg. That is, scale 76 may be positioned at one or more points along the contour of the instep and the height and horizontal position of each point can be read from the vertical scales on alignment posts 50 and the scales on the horizontal extensions of brackets 76B.

In other embodiments the alignment posts 50 may be replaced by a single alignment post 50 extending upwards, for example, at the back side of heel support 28 to allow the alignment of the ankle or leg with the foot to be determined visually, or the back side of heel support 28 may extend upwards to enclose the back of the ankle and lower leg in the manner of a snowboard boot for the same purpose. In still other embodiments, the alignment posts 50 may be located on either side of the ankle, instead of forward of the ankle, and may include sliding scales 78 to contact the sides of the ankle and/or lower leg to allow the alignment of the ankle or leg with the foot to be measured. In still other embodiments, one of the alignment posts 50 or, for example, the upward extension of heel support 28, may include an apparatus such as an enclosing clamp or tape measure 80 to determine the thickness of the ankle or lower part of the leg.

Figure 13A:
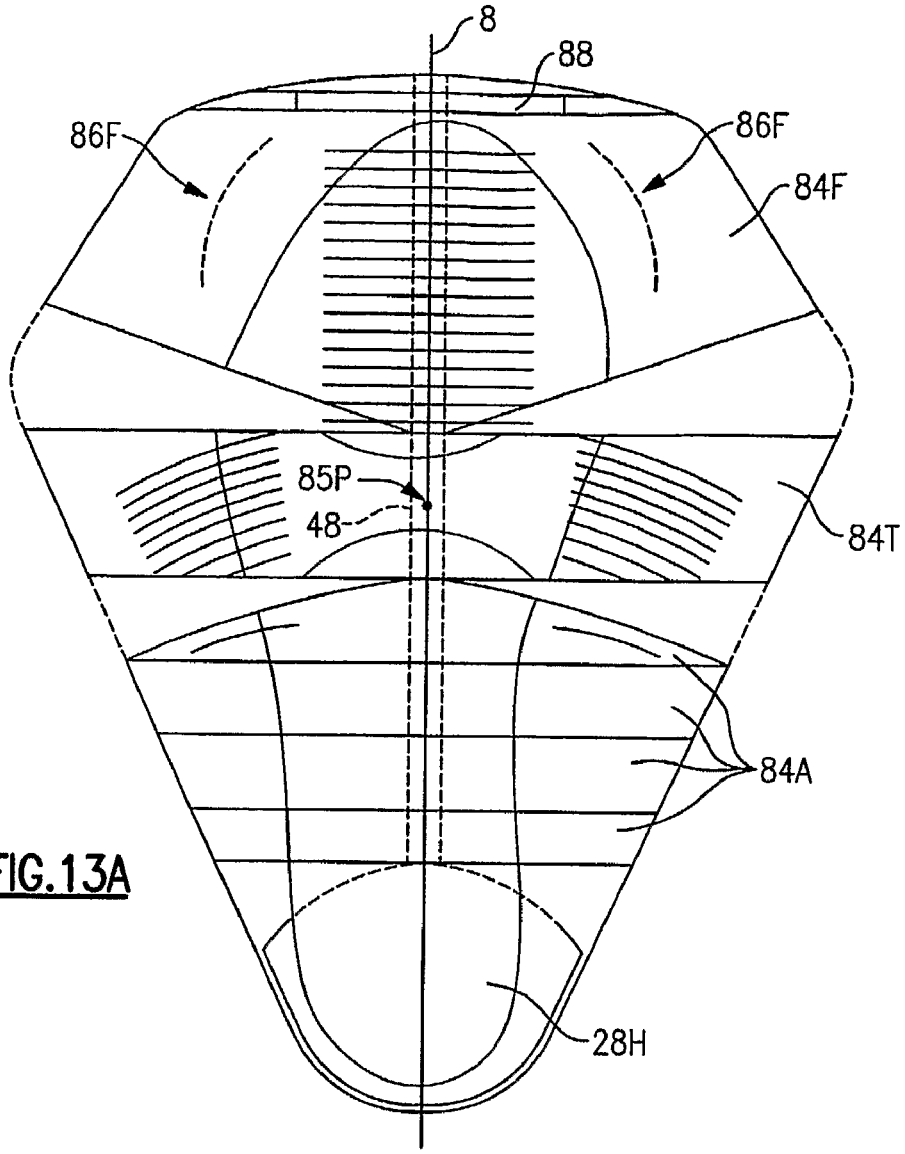

Continuing with further and alternate embodiments of a device 2, it has described herein above that the foot and its measurements are divided into medial and lateral halves along a centerline 3. It is also described that in one embodiment the centerline 3 is located along the second toe, and that the foot is aligned with centerline 3 by means of a toe plate 6. In other embodiments, and for example, the alignment of the foot with centerline 3 may be accomplished using other selected parts of the foot, such as the first toe or the medial or lateral sides of the foot, and, for example, a sliding lateral offset scale 82 such as illustrated in FIG. 13A, or by adjusting the structures and scales of the device 2 to a different location of the "centerline 3". In an alternative embodiment, and for example, the lateral offset scale 82 may be implemented as a pivoted indicator similar in construction to foot width measuring device 18 as illustrated in FIG. 9 wherein a pivot arms is pivoted on the underside of base plate 4 at a point in the region of pivot 34 of heel support 28 and passes to the top side of base plate 4 through an elongate slot located toward the toe region of the foot, with the toe end of the pivot arm bearing a longitudinally sliding indicator to locate or indicate the selected centerline, perhaps similar to foot fin 6, and a scale indicating foot length.

Considering yet further embodiments and implementations of the present invention, it is often desirable to be able to adjust the medial/lateral tilt and fore/aft tilt of the fore section 5F, metatarsal section 5T, and anterior section 5A of the base plate 4, as well as the medial/lateral and fore/aft tilts of the heel section 5H, as has been described above, and to control the degree of contact, if any, between these plates and the foot. These features allow, for example, the device 2 to accommodate corresponding tilts of various corresponding regions of the foot or the foot to be supported only at selected points, such as the heel and the first or second metatarsal heads 22 and 24, thereby more accurately defining the shape and support requirements of the foot.

Figure 13C:
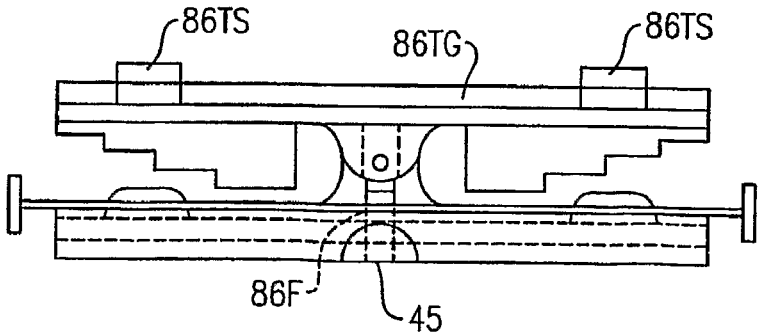
Figure 13B:
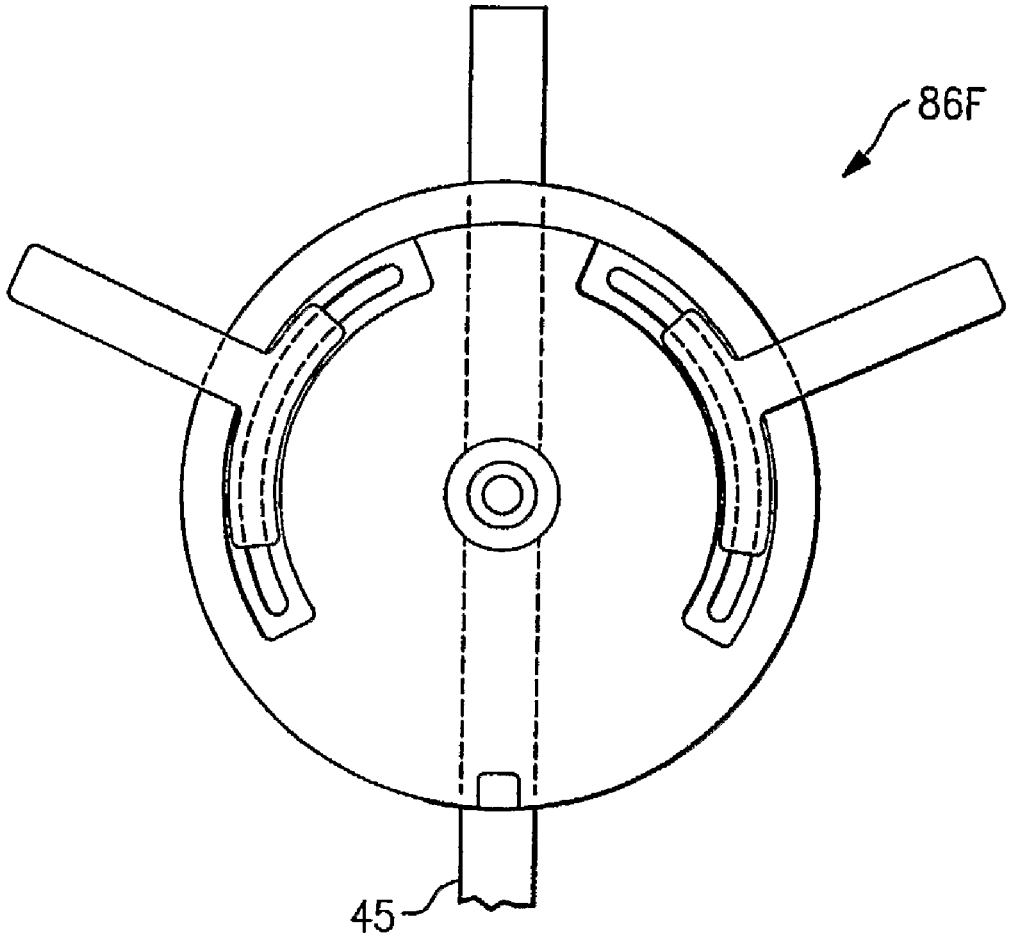

For these purposes and as illustrated diagrammatically for an exemplary embodiment in FIG. 13B, for example, the foot support structure of the device 2 may be constructed as a set of adjustable base plates 84 supported by a lower base plate 4A or by the floor wherein the plates 84 include a fore plate 84F, a metatarsal plate 84T, and anterior plate 84A and include a heel support 28, constructed as described above, with the relative fore/aft and medial/lateral tilts or heights of each plate 84 and the heel support 28 being independently controllable. In this regard, it must be noted that while the position of heel support 28 may be fixed relative to the overall structure of the device 2, such as with respect to base plate 4, and the location of fore plate 84F may be fixed relative to metatarsal plate 84T, the fore/aft positions of fore plate 84F and metatarsal plate 84T and the longitudinal space occupied by anterior plate 84A must be adjustable along centerline 3 to adapt to differing foot lengths.

Therefore considering an exemplary construction of fore plate 84F, metatarsal plate 84T, anterior plate 84A and heel support 28 in further detail, it will be assumed for purposes of the following discussion that fore plate 84F, metatarsal plate 84T, anterior plate 84A and heel support 28 and their respective tilt mechanisms are supported on a lower base plate 4L that rests on the floor. It will be recognized, however, that the structural and operational purposes of a lower base plate 4L can be equally met by means of individual base elements resting on the floor and individually supporting the tilt mechanisms of fore plate 84F, metatarsal plate 84T, anterior plate 84A and heel support 28. Further in this regard, and because it is necessary that the longitudinal positions of at least the fore plate 84F and metatarsal plate 84T and possibly the anterior plate 84A to be adjustable along centerline 3 of the device 2, lower base plate 4L may be provided with a longitudinal channel to constrain the side to side and rotational motion of the plate 84 support/tilt structures. In this instance, the plate 84 support/tile structures may include pivot supports, analogous to an inverted form of pivot 34, which will engage with the plate 4L channel to allow side to side and fore/aft tilting of the plates and longitudinal movement of the plates. In implementations not having a lower plate 4L, the lower part of device 2 may include a longitudinal shaft 4A of appropriate cross section, such as round or semi-cylindrical, to provide the same support and motion capabilities, with the support pivots of the plate support/tilt mechanisms being adapted accordingly.

As illustrated in FIG. 13A, heel support 28 may be constructed as described herein above with respect to FIG. 2C, with a tilt mechanism, indicated generally in FIG. 13A as tilt mechanism 86H, as shown and described with reference to FIG. 2C and with the pivot 34 being in a fixed location with regard to the overall structure of the device 2, such as with respect to lower base plate 4L.

Fore plate 84F can be supported by a tilt mechanism similar to that of heel support 28 and indicated in FIG. 13A and FIG. 13B as fore tilt mechanism 86F engaging with either the longitudinal channel in lower plate 4L or a longitudinal shaft 4S. In the case of fore tile mechanism 86F, however, the fore/aft orientation of tilt mechanism 86F is reversed with respect to the fore/aft orientation of the tilt mechanism of heel support 28. The reversed orientation of fore tilt mechanism 86F would thereby cause fore plate 84F to generally tilt longitudinally upwards and downwards and to move upwards and downwards with respect to the juncture between fore plate 84F and metatarsal plate 84T in a manner analogous to the movement of heel support 28 but reversed. Fore tilt mechanism 86F would also allow fore plate 84F to tilt from side to side with respect to centerline 3, as described above and as described with respect to heel support 28.

It should also be noted with regard to fore tilt mechanism 86F that it will be generally desirable to provide fore plate 84F with greater latitudes of tilt and upward/downward movement with respect to metatarsal plate 84T than is necessary in the mechanism of heel support 28, thereby allowing, for example, the fore part of the foot to be supported solely by metatarsal plate 84T. For this reason, the dimensions and number of cam surfaces 48A-48n of the cam structures 47B of fore tilt mechanism 86F will typically be adapted, that is, enlarged and extended, to allow fore plate 84F to tilt downwards away from the junction abutting metatarsal plate 84T, as well as upwards, and to allow a greater vertical movement of fore plate 84F with respect to metatarsal plate 84T. It should also be noted that fore tilt mechanism 86F may be linked to metatarsal tilt mechanism 85T so that plates 84F and 84T will adjustable as a unit with respect to their longitudinal position along centerline 3, or fore tilt mechanism 86F and fore plate 84F may be independent of metatarsal tile mechanism 86T and metatarsal plate 84T.

Next considering the construction of metatarsal plate 84T, as described metatarsal plate 84T is preferably capable of fore and aft movement along centerline 3 to adjust to different foot lengths. For a related reason, that is, because the angle of the axis of metatarsal heads 22,24 will vary with foot length and width, it is preferable that metatarsal plate 84T be capable of rotation above a vertical axis passing through centerline 3 at the current location of metatarsal plate 84T. It may also be desirable that metatarsal plate 84T be capable of side to side tilt, but it is generally not necessary that metatarsal plate 84T be capable of fore/aft tilt.

Referring therefore to FIGS. 13A and 13C, which is a diagrammatic illustration of an exemplary embodiment of a metatarsal plate 84T and metatarsal tile mechanism 86T, it is shown therein that metatarsal plate 84T is essentially a laterally elongated plate supported on a rotatable pivot 86P that is supported and restrained in either the longitudinal channel in lower base plate 4L or a sliding element mounted onto longitudinal shaft 4S. In those implementations not requiring metatarsal plate 84T to tilt from side to side, metatarsal plate 84T may be made of sufficient depth that the lower side of metatarsal plate 84T bears against lower plate 4L or the floor, thereby stabilizing metatarsal plate 84T against tipping while allowing metatarsal plate 84T to rotate about its central vertical axis.

In those implementations wherein it is desired that metatarsal plate 84T tilt from side to side as well as rotate, and as illustrated in exemplary embodiment in FIG. 13C, metatarsal plate 84T may be constructed as two horizontal, vertically aligned arms with the upper arm, that is, the arms supporting the metatarsals, being pivoted about the upper end of the central vertical axis pivot. The lower side of the upper arm, for example, would be provided with a continuous or stepped ramp, analogous to that of tilt elements 36,38, bearing upon a cam block sliding along the top of the lower arm. The position of the cam block along the lower arm can be adjusted by, for example, a threaded rod connected to the pivot and engaging a threaded engaging element in the cam block and rotated by a knob on the outer end of the rod.

It must also be noted that, as described above, the horizontal rotation of metatarsal plate 84T about a central vertical axis to accommodate the varying the angle of the axis of metatarsal heads 22,24 with differences in foot length and width will result, as illustrated in FIG. 13B, in forward and backward movement lateral extends of the metatarsal plate 84T and thereby possible interference with fore plate 84F and anterior plate 84A. This movement of metatarsal plate 84T may be accommodated in a number of ways. For example, fore plate 84F and anterior plate 84A may be longitudinally spaced apart from metatarsal plate 84T by distances sufficient to accommodate the horizontal rotation of metatarsal plate 84T without mechanical interference. In an alternative embodiment, as illustrated in FIG. 13B, the edges of fore plate 84F and anterior plate 84A may be cut away at horizontal slants to accommodate the movement of metatarsal plate 84T.

Lastly with respect to metatarsal plate 84T, it is often desirable to take measurements of a foot while the foot is supported at two or more selected points of particular significance, such as the heel and either the first or fifth metatarsals 22,24 or the heel and the first and fifth metatarsals 22,24, while leaving the anterior and fore parts of the foot unsupported. For this reason, metatarsal plate 84T may be provided with one or more adjustable metatarsal supports 88 that may be selectively positioned, for example, under either or both of the first and fifth metatarsals 22,24 to provide such selective support. As the same time, the support may be removed from under the fore and anterior parts of the foot by appropriate adjustment of fore plate 84F and anterior plate 84A.

It will be appreciated that there are a number of methods and structures that can be used to provide selectable support under, for example, either or both of the first and fifth metatarsals 22,24. For example, metatarsal plate 84T may include one or more metatarsal supports 86TS moveably mounted in a lateral groove 86TG extending across metatarsal plate 84T wherein the upper surface of each metatarsal support 86TS extends above the upper surface of metatarsal plate 84T to support one or more metatarsals while isolating the remaining metatarsals from contact with metatarsal plate 84T. In an alternate embodiment, metatarsal supports 86TS may be fabricated with a generally "mushroom" shape having a support head extending above the top surface of metatarsal plate 84T and a shaft fitting into selected one of a plurality mounting holes 86TH.

Referring next to anterior plate 84A, it has been described herein above that the longitudinal space for anterior plate 84A will vary with the length of the foot being measured. At a minimum, the space available for anterior plate 84A will extend from the forward side of heel support 28 to the aftermost location of metatarsal plate 86T, which generally corresponds with the aftermost measurement position of foot width measuring devices 18, 20, which would correspond with the shortest foot to be measured. The maximum space available for anterior plate 84A will, in turn, extend from the forward edge of heel support 28 to the most forward position metatarsal plate 84T, which corresponds with the maximum length foot to be measured. For these reasons, therefore, the device 2 may be provided with, for example, a single anterior plate 84A having a length corresponding to space available when measuring the minimum size foot, thereby accepting the existence of a gap between the anterior plate 84A and either the metatarsal plate 84T or the heel support 28. In an alternate embodiment, the device 2 may be provided with a plurality of anterior plates 84A of varying length with the anterior plate 84A used for any specific foot measurement being dependent upon the size of the foot, which would reduce the extent of the gaps in the support provided by the anterior plage 84A.

It should also be noted that it may be desirable that anterior plate or plates 84A be capable of a selectable side to side tilt. In such implementations, and for example, the anterior plate or plates 84A may be constructed in a manner similar to metatarsal plate 84T. That is, each anterior plate 84A may be constructed as two horizontal, vertically aligned arms with the lower arm resting on and being supported by, for example, lower plate 4L or the floor and constrained so as to be centered along centerline 3 by longitudinal shaft 4S, as discussed above with regard to metatarsal plate 84T and fore plate 84F. The central part of the upper arm, that is, the arm abutting and supporting the anterior part of the foot, is pivoted on the central part of the lower arm, that is, at centerline 3, to allow lateral tipping of the upper arm about a point centered on centerline 3. The degree of tilt of the upper arm, in turn, can be controlled by a number of mechanisms. For example, and as discussed above, the lower side of the upper arm could be provided with a continuous or stepped ramp, analogous to that of tilt elements 36,38, bearing upon a cam block sliding along the top of the lower arm. The position of the cam block along the lower arm can then be adjusted by, for example, a threaded rod connected at the center of the lower arm and engaging a threaded engaging element in the cam block. The threaded rod can then be rotated by a knob on the outer end of the rod to adjust the position of the cam block along the arms and thereby the degree and direction of tilt of the anterior plate 48A. As indicated in FIG. 13C, the provision of a cam mechanism on either side of the centerline, that is, on either side of the pivot 86P and the use of a vertically pivot 86P having a vertically adjustable length will permit adjustment of the height as well as the tile of the anterior plate 84A. It will also be appreciated that the anterior plate 84A, or each anterior plate 84A, may alternatively be provided with a pivot and tilt/height adjustment mechanism similar to the pivot and tilt/height adjustment mechanism used with heel support 28.

It will be understood by those of skill in the relevant arts that yet further and other alternate implementations of the above described device 2 may be implemented. For example, the various mechanical mechanisms described above for controlling the height and tilt of the plates may be replaced, in whole or in part, by other actuation means, such as hydraulic or electro-magnetic devices. In further example, the fore, metatarsal and anterior plates 84F, 84T and 84A and the heel support 28 may be equipped with additional shaped plates that mount or key onto the basic fore, metatarsal and anterior plates 84F, 84T and 84A and the heel support 28 to adjust, for example, the relative height or horizontal angles of the plates. The additional plate elements may be used in addition to the height and tilt adjustment mechanisms described above, or in place of the height and tilt adjustment mechanisms. In addition, certain of the plates, including the fore plate 84F, metatarsal plate 84T, anterior plate 84A and the heel support 28 may be provided with attachable or built in structures emulating and reproducing elements of certain types of footwear to size a foot under certain specific conditions. For example, heel support 28 may be constructed as or have an add-on element shaped in the manner of the heel section of a ski or snowboard boot, and fore plate 84F may be shaped as or have an addition shaped as a toe cup section of a ski or snowboard boot, and so on.

In further embodiments of a device 2, and or all of fore plate 84F, metatarsal plate 84T, anterior plate 84A and heel support 28 may be provided with arrays of pressure sensors to measure and indicate the distribution of weight on various areas of a foot. The pressure sensor arrays may be, for example, built into the plates, superimposed on the plates as additional, optional fittings, or implemented in alternate replacement plates for any or all the fore plate 84F, metatarsal plate 84T, anterior plate 84A and heel support 28. Alternatively, any of all of the fore plate 84F, metatarsal plate 84T, anterior plate 84A and heel support 28 may be replaced or superimposed by a single plate covering the region or regions of interest. In addition, the sensors may be implemented in any of a variety of forms, such as arrays of electrical, piezoelectric or capacitive pressure sensors, arrays of depressable pins connected to sensors, optical scanning devices, and so on.

It will be appreciated by those of appropriate skill in the relevant arts that certain modifications, adaptations and changes in the above described embodiments may be made while remaining within the bounds of the described invention. For example, rather than providing individual tilt mechanisms for some or all of the fore plate, the metatarsal plate, the anterior plate and the heel support, base plate, the base plate may be mounted onto a pivot or tilt/lift mechanism similar, for example, to that described for heel support 28 and fore plate 5F, thereby allowing the entire device to be tilted and elevated or depressed according to the requirements of the desired measurements.

In yet further embodiments, one or both vertical alignment posts may be mounted onto a laterally sliding bar to permit direct measurement of the tilt or offset of, for example, an ankle or knee with respect to the foot. In addition, one or both of the vertical support bars may be movable to a lateral horizontal position to measure a distance between one foot and the other foot, or a separate scale may be provided for this purpose. Still further, a pair of devices 2 may be combined into a single measurement and alignment device to allow the measurement and alignment of both feet at the same time.

In still other embodiments, the measurement scales illustrated in the above discussed embodiments of the invention may be implemented by means of optical devices or mechanically moving devices, such as calipers of sliding contacts controlling, for example, resistive elements, and the measurements may be displayed, for example, by digital displays rather than by visual reading of scales. It will also be appreciated that in certain embodiments the measurement mechanisms described herein above, such as elements 14, 26, 62, 18 and so on, may be implemented as directly readable measurement scales rather than as moving mechanisms combined with measurement scales, and that the scales may be printed, painted, embossed or otherwise marked on the device in the suitable manner and may be expressed by any suitable legends, including braille type touch reading scales.

It will also be appreciated that various modifications and alternate implementations of the vertical alignment measurement mechanisms described above are also possible within the scope of the invention. For example, a single vertical alignment post located, for example, behind the heel support area of the device may include a mirror to aid in determining alignment of the ankle or leg with the foot, possible combined with a "gunsight" mounted at the fore part of the device, such as on a laterally sliding bar. In another embodiment, the cross bar 68 for mounting the laser 66 may be extended forward to allow greater flexibility in the vertical scanning of the laser, such as to the shoulder of the person whose foot is being measured. In addition, cross bar 68 may be horizontally pivoted on the base plate or fore plate to allow the laser 66 to be rotated upward and positioned at, for example, the knee or shoulder, with the laser beam being directed downwards therefrom to a scale on the device, thus reversing the alignment measurement. In a yet further embodiment, and as described briefly herein above, the joint mechanism by which the laser is mounted to the cross bar 68 may include a "sun dial" lateral pivot, indicated by lateral pivot mounting disk 68, to allow the laser 66 to be traversed in a lateral plane relative to the axis of the laser 66 as well as in the vertical plane.

Considering still further embodiments of the present invention, it has been described herein above that the foot measurements are taken with respect to a centerline C extending between the lateral and medial halves of the foot, and it has been described that in certain embodiments the centerline C may be indicated by means of a laterally movable element, thereby allowing the measurement centerline and the longitudinal axis along which the foot is divided into medial and lateral halves to be located laterally at any preferred point. It will also be appreciated that the line along which the fore, metatarsal and anterior plates are divided into medial and lateral sub-plates may be similarly adjustable by, for example, laterally sliding supports for the plates, thereby allowing the dividing line separating the plates, and the tilt/lift mechanisms, to be individually or jointly laterally positioned as desired.

Since certain changes may be made in the above described improved measuring or sizing device, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A foot measuring or sizing device for measuring a foot to be measured, the foot measuring or sizing device comprising:

a base platform;

a heel support sized to support a heel portion of the foot to be measured, and the heel support being pivotally connected to the base platform;

the foot measuring or sizing device having a measurement scale for indicating at least a length dimension of the foot to be measured; and at least one vertical alignment mechanism, spaced from the heel support, for providing a visual indication to an operator, of the measuring or sizing device, of any deviation from a desire vertical alignment of an ankle of the foot being measured.

2. A foot measuring or sizing device for measuring a foot to be measured, the foot measuring or sizing device:

a base platform;

a heel support sized to support a heel portion of the foot to be measured, and the heel support being pivotally connected to the base platform so that the heel support can pivot, relative to the base platform, and such pivoting of the heel support also alters vertical alignment of an ankle of the foot to be measured relative to the base platform;

the foot measuring or sizing device having a measurement scale for indicating at least a length dimension of the foot to be measured;

a foot fin supported by the base platform and the foot fin being slidably along an elongate slot formed in the base platform to facilitate alignment of the foot to be measured with a central plane of the foot measuring or sizing device prior to reading a length of the foot to be measured from a length scale;

at least one vertical alignment mechanism, spaced from the heel support, for providing a visual indication to an operator, of the measuring or sizing device, of any deviation from a desire vertical alignment of the ankle of the foot being measured.

3. The foot measuring or sizing device according to claim 2, wherein a foot length measurement scale is provided on the top surface of the base platform and the foot length measurement scale provides a visual indication of the length dimension of the foot to be measured.

4. The foot measuring or sizing device according to claim 2, wherein the foot fin is sized to be accommodated, during use, between a big toe and an adjacent toe of the foot to be measured prior to determining the length of the foot.

5. The foot measuring or sizing device according to claim 2, wherein the measuring or sizing device further includes a pair of spaced apart foot width measuring devices, with a first one of the pair of foot width measuring devices for supporting a first metatarsal head of the foot of the person while a second one of the spaced apart foot width measuring device for supporting a fifth metatarsal head of the foot to be measured.

6. The foot measuring or sizing device according to claim 5, wherein each one of the first and second foot width measurement devices is slidable along a support shaft, and a first end of each of the support shafts is pivotally attached adjacent the heel support of the base platform to permit arcuate pivoting motion of the foot width measurement devices while the opposite end of the support shaft is connected to a slide member which slides along an accurate slot provided in the top surface of the base platform and is the pivoting motion is confined by a pair of opposed end stops.

7. The foot measuring or sizing device according to claim 2, wherein the heel support has a base surface which supports the heel of the foot to be measured and a rear wall which provides a reference surface against which a rear portion of a heel of the foot to be measured abuts to facilitate determining a length of the person's foot to be measured.

8. The foot measuring or sizing device according to claim 2, wherein the heel support has a pair of spaced apart first cam surfaces while the top surface of the base platform carries a pair of spaced apart mating second cam surfaces such that a first one of the first cam surfaces cooperates with a first one of the mating second cam surfaces and the other first cam surface cooperates with the other mating second cam surface, and a lifting head of a tilting or lifting element is located between each mating pair of first and second cam surfaces to facilitate tilting or lifting of the heel support relative to the base platform.

9. The foot measuring or sizing device according to claim 2, wherein an alignment upright is located on each side of the heel support and the alignment uprights provide a visual indication to an operator, of the measuring or sizing device, as to whether or not an ankle/shin of the foot to be measured is aligned substantially parallel to the alignment uprights.

10. The foot measuring or sizing device according to claim 2, wherein the measuring or sizing device further includes at least one foot width measuring device for measuring a width of the foot to be measured.

11. The foot measuring or sizing device according to claim 2, wherein the foot measuring or sizing device has pair of clearance elements, located between the heel support and the foot width measuring devices, and each one of the clearance elements is slidable underneath the foot to be measured to confirm that there is sufficient clearance between a bottom of the foot to be measured and a top surface of the base platform.

12. A foot measuring or sizing device comprising:

a base platform;

a heel support for support a heel portion of a foot to be measured, and the heel support being pivotally connected to the base platform;

the foot measuring or sizing device having a measurement scale for indicating at least a length dimension of the foot to be measured;

a foot fin supported by the base platform and the foot fin being slidably along an elongate slot formed in the base platform to facilitate alignment of the foot to be measured with a central plane of the foot measuring or sizing device prior to reading a length of the foot to be measured from a length scale;

at least one slidable foot width measurement device for engaging with a first metatarsal head of the foot during use; and a pair of alignment uprights being located on opposite sides of the heel support to provide a visual indication to an operator of the measuring or sizing device that an ankle/shin of the foot to be measured is aligned substantially parallel to the alignment uprights.

13. The foot measuring or sizing device according to claim 12, wherein the heel support has a rear wall which provides a reference surface against which a rear portion of a heel of the foot to be measured abuts to facilitate determining the length of the foot to be measured.

14. The foot measuring or sizing device according to claim 12, wherein the heel support has a pair of spaced apart first cam surfaces while the top surface of the base platform carries a pair of spaced apart mating second cam surfaces such that a first one of the first cam surfaces cooperates with a first one of the mating second cam surfaces and the other first cam surface cooperates with the other mating second cam surface, and a lifting head of a tilting or lifting element is located between each mating pair of first and second cam surfaces to facilitate tilting or lifting of the heel support.

15. The foot measuring or sizing device according to claim 12, wherein the measuring or sizing device further includes at least one foot width measuring device.

16. A foot measuring device comprising:

a base platform, a length measurement mechanism for measuring a length of a foot to be measured along a selected foot centerline;

at least one of a medial measuring mechanism, for measuring a medial arch length of the foot to be measured relative to a centerline of the foot at a first metatarsal, and a lateral measurement mechanism for measuring a lateral width of the foot to be measured relative to the centerline of the foot at a fifth metatarsal; and at least one vertical alignment mechanism, spaced from the heel support, for providing a visual indication to an operator, of the measuring or sizing device, of any deviation from a desire vertical alignment of an ankle of the foot being measured.

17. The foot measuring device of claim 16, further comprising a heel support pivotally connected to the base platform and including a tilt mechanism for controlling a fore and aft tilt and a side to side tilt of a heel of the foot and an elevation of the heel relative to the base platform.

18. The foot measuring device of claim 16, further comprising:

a fore plate under a fore part of the foot;

a metatarsal plate under a metatarsal part of the foot;

at least one anterior plate under an anterior part of the foot; and a heel support;

wherein the fore plate is longitudinally adjustable according to the length of the foot;

the metatarsal plate is longitudinally adjustable and pivotal about a central axial point according to an arch length of the foot axis;

the at least one anterior plate is longitudinally adjustable according to the arch length of the foot; and the heel support is pivotally connected to the base platform and includes a tilt mechanism for controlling a fore and aft tilt and a side to side tilt and an elevation of the heel support relative to the at least one anterior plate.

19. The foot measuring device of claim 18, wherein:

the fore plate is pivotally connected to the base platform and includes a tilt mechanism for controlling a fore and aft tilt and a side to side tilt of the fore part of the foot and an elevation of the fore plate relative to the metatarsal plate, the at least one anterior plate is pivotally connected to the base platform and includes a tilt mechanism for controlling a side to side tilt of the anterior part of the foot and an elevation of the anterior plate relative to the metatarsal plate.

20. The foot measuring device of claim 16, wherein the medial measuring mechanism for measuring a medial arch length of the foot relative to a centerline of the foot at a first metatarsal comprises:

an arch length indicator slidable along a support shaft having a first end pivotally attached adjacent the heel support to permit arcuate pivoting motion of the arch length indicator, the shaft engaging with an accurate slot in the top surface of the base platform to control arcuate motion of the shaft.

21. The foot measuring device of claim 16, wherein the lateral measurement mechanism for measuring a lateral width of the foot relative to the centerline of the foot at a fifth metatarsal comprises:

a laterally slidable element engaging with a rear portion of the base platform, at least one width sensing element extending forward from the laterally slidable element for contacting a lateral side of the foot at the fifth metatarsal, and a width scale for indicating the lateral width of the foot relative to the centerline of the foot at a fifth metatarsal dependent upon a lateral position of the width sensing element.

22. The foot measuring device of claim 16, further comprising an adjustable centerline indicator for indicating a selected centerline between the medial and lateral sides of the foot.

23. The foot measuring device of claim 16, wherein the at least one vertical alignment mechanism, spaced from the heel support, is at least one alignment upright located adjacent the heel support which provides a visual indication to an operator of the measuring device of the degree of alignment of the foot with respect to one of the ankle or leg.

24. The foot measuring device of claim 23, further comprising a horizontally extending scale mounted on the at least one alignment upright for measuring an offset of one of an ankle and a leg with respect to the foot.

25. The foot measuring device of claim 24, wherein the horizontal scale is vertically positionable along the alignment upright and the alignment upright includes a vertical measurement scale for measuring a height of an instep of the foot.

26. The foot measuring device of claim 16, further including an alignment indicator comprising a laser mounted on one of the base platform, the fore plate and the heel support and and rotatable in a vertical plane to indicate by a laser beam transmitted in a vertical plane a vertical alignment between the foot and at least one of an ankle and a leg.

27. A foot measuring device comprising:

a base platform;

a length measurement mechanism for measuring a length of a foot along a selected foot centerline;

at least one vertical alignment mechanism, spaced from the heel support, for providing a visual indication to an operator of the measuring device of the degree of alignment of the foot with respect to at least one of the ankle and the leg; and a foot fin supported by the base platform, the foot fin being sized to be accommodated, during use, between a big toe and an adjacent toe of the foot to be measured and being lidably along an elongate slot formed in the base platform to facilitate alignment of the foot to be measured with a central plane of the foot measuring or sizing device prior to reading a length of the foot to be measured from a length scale.

* * * * *